US006634892B2

(12) United States Patent
Nakamura

(10) Patent No.: US 6,634,892 B2
(45) Date of Patent: Oct. 21, 2003

(54) ELECTRICAL CONNECTOR HOUSING

(75) Inventor: Masayoshi Nakamura, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 09/921,909

(22) Filed: Aug. 6, 2001

(65) Prior Publication Data

US 2002/0016093 A1 Feb. 7, 2002

(30) Foreign Application Priority Data

Aug. 7, 2000 (JP) ..... 2000-238838

(51) Int. Cl.[7] ..... H01R 12/00

(52) U.S. Cl. ..... 439/76.2; 439/67; 439/77; 439/210; 439/212; 439/404; 439/752; 439/949

(58) Field of Search ..... 439/76.2, 949, 439/76.1, 752, 404, 76, 67, 210, 212

(56) References Cited

U.S. PATENT DOCUMENTS 4,689,718 A * 8/1987 Maue et al. ..... 361/360
5,057,026 A * 10/1991 Sawai et al. ..... 439/76
5,478,244 A * 12/1995 Maue et al. ..... 439/76.2
5,529,502 A * 6/1996 Peltier et al. ..... 439/67
5,764,487 A * 6/1998 Natsume ..... 361/775
5,895,277 A 4/1999 Saka et al.
5,928,004 A * 7/1999 Sumida et al. ..... 439/76.2
5,973,409 A * 10/1999 Neibecker et al. ..... 307/10.1
5,980,302 A * 11/1999 Saka ..... 439/404
5,995,380 A * 11/1999 Maue et al. ..... 361/826
6,077,102 A * 6/2000 Borzi et al. ..... 439/364
6,116,916 A * 9/2000 Kasai ..... 439/76.2
6,126,457 A * 10/2000 Smith et al. ..... 439/76.2
6,220,875 B1 * 4/2001 Kawakita ..... 439/76.2

FOREIGN PATENT DOCUMENTS

EP 0793249 9/1997
JP 59220009 12/1984

* cited by examiner

*Primary Examiner*—P. Austin Bradley
*Assistant Examiner*—Truc Nguyen
(74) *Attorney, Agent, or Firm*—Greenblum & Bernstein, P.L.C.

(57) ABSTRACT

An electrical connector housing includes a first shell carrying connector mounts, fuse mounts and relay mounts. A second shell comprises second connector mounts, and fitted to the first shell. The electrical connector housing contains a connector circuitry module, a fuse circuitry module, a relay circuitry module and a printed board. The connector circuitry module includes connector-connecting circuitry formed of a first bus bar stack and a flexible printed board, while the fuse circuitry module includes fuse-connecting circuitry formed of a second bus bar stack. Likewise, the relay circuitry module includes relay-connecting circuitry formed of a third bus bar stack.

9 Claims, 5 Drawing Sheets

ELECTRICAL CONNECTOR HOUSING

BACKGROUND OF THE INVENTION

1. Field of the Invention

The present invention relates to an electrical connector housing for mounting in a vehicle, e.g., a car (automobile). In particular, the invention concerns an electrical connector housing containing separate modules for connectors, fuses and relays, respectively.

2. Description of Background Information

Electrical devices such as relays, fuses and connectors for vehicles are typically placed inside an electrical connector housing, which is itself fitted within a vehicle. In the case of a bus bar-containing electrical connector housing, the above electrical devices are connected through connecting circuits composed of bus bars.

In such a housing, bus bars forming groups are layered between insulator materials to form a bus bar stack. The latter serves as connecting circuit elements for electrical devices. Typically, such a bus bar stack contains connecting circuits used indifferently for relays, fuses and connectors.

As all types of connecting circuits are formed into a single bus bar stack, another bus bar stack has to be prepared when a connecting circuit must be configured differently. Known bus bar stacks thus lack wide flexibility to adapt to different configurations.

Recent years have also witnessed an intensified search for smaller and lighter electrical connector housings for vehicle borne applications. However, the prior art single bus bar stack system has a handicap in this respect. Namely, miniaturization or lightening of the bus bar stack by changing wiring configurations or by reducing the number of layers has its limit, and a large improvement is difficult to achieve by these methods.

SUMMARY OF THE INVENTION

In the above context, the present invention aims at miniaturizing and lightening an electrical connector housing, and at widening its usability.

To this end, there is provided an electrical connector housing including a first shell carrying connector mounts, fuse mounts and relay mounts, and a second shell fitted to the first shell, the electrical connector housing containing at least a first bus bar stack formed by a lamination of at least one group of bus bars and layers of insulator material e.g., insulator sheets. The electrical connector housing of the present invention further includes a connector circuitry module formed of the first bus bar stack and including connector-connecting circuits wired into the connector mounts, a fuse circuitry module including fuse-connecting circuits wired into the fuse mounts, a relay circuitry module including relay-connecting circuits wired into the relay mounts; and the connector circuitry module further includes a flexible printed board containing conductor patterns.

Preferably, the first bus bar stack includes bus bar terminals projecting therefrom and arranged into the fuse mounts and the relay mounts, the first bus bar stack including an area where no bus bar terminal is formed, and the flexible printed board is arranged in the area.

The area may include that face of the first bus bar stack where no bus bar terminal is provided.

Preferably, the electrical connector housing contains a second bus bar stack formed by laminating at least one group of bus bars and layers of insulator material, and the fuse circuitry module is formed of the second bus bar stack.

Further, the first bus bar stack may include bus bar terminals projecting therefrom and arranged into the fuse mounts and the relay mounts, the first and second bus bar stacks including an area where no bus bar terminal is formed, and the flexible printed board is arranged in the area.

The area may include those faces of the first and second bus bar stacks where no bus bar terminal is provided.

Suitably, the electrical connector housing contains a third bus bar stack formed by laminating at least one group of bus bars and layers of insulator material, and the relay circuitry module is formed of the third bus bar stack.

Further, the first bus bar stack may include bus bar terminals projecting therefrom and arranged into the fuse mounts and the relay mounts, the first, second and third bus bar stacks including an area where no bus bar terminal is formed, and the flexible printed board is arranged in the area.

The area may include those faces of the first, second and third bus bar stacks where no bus bar terminal is provided.

Typically, the bus bars of the first, second and third bus bar stacks are electrically connected to one another by welding, and the flexible printed board and at least one of the first, second and third bus bar stacks are clamped by clips, so that the conductor patterns of the flexible printed board and the bus bars of the first, second and third bus bar stacks are electrically connected.

Preferably, the fuse circuitry module further includes a flexible printed board containing conductor patterns.

Preferably yet, the relay circuitry module further includes a flexible printed board containing conductor patterns.

As can be understood from the forgoing, according to a first embodiment of the invention, the connector-connecting circuits, fuse-connecting circuits and relay-connecting circuits are respectively formed as separate modules. When only one type of connecting circuit is re-configured, only the circuit module concerned needs to be changed. In addition, at least part of the connector circuitry module is formed of a flexible printed board, so that this module becomes smaller and lighter. Consequently, the electrical connector housing made of this module can also be made smaller and lighter. The thus-obtained electrical connector housing acquires a wider usability.

According to a second embodiment of the invention, the flexible printed board does not require a structure through which bus bar terminals are passed. Further, the wiring can be designed easily, in ways that the conductor patterns in the flexible printed board do not interfere with the bus bar terminals. The structure of the flexible printed board can thus be simplified, its design and production becoming easier. Likewise, the flexible printed board can be kept as small as possible.

The structure of the flexible printed board can thus be simplified, and its design and production become easier.

According to a third embodiment of the invention, different circuit modules can be connected electrically in a more secured way. Further, the conductor patterns of the flexible printed board and the bus bars in the bus bar stack are connected through connecting clips. The connections therebetween are thus easy and sure. As a result, the conductor patterns of the flexible printed board and the bus bars in the bus bar stacks are connected in an easy and secure way.

BRIEF DESCRIPTION OF THE DRAWINGS

The above, and the other objects, features and advantages of the present invention will be made apparent from the following description of the preferred embodiments, given as non-limiting examples, with reference to the accompanying drawings, in which.

DETAILED DESCRIPTION OF THE PREFERRED EMBODIMENTS

Figure 1:
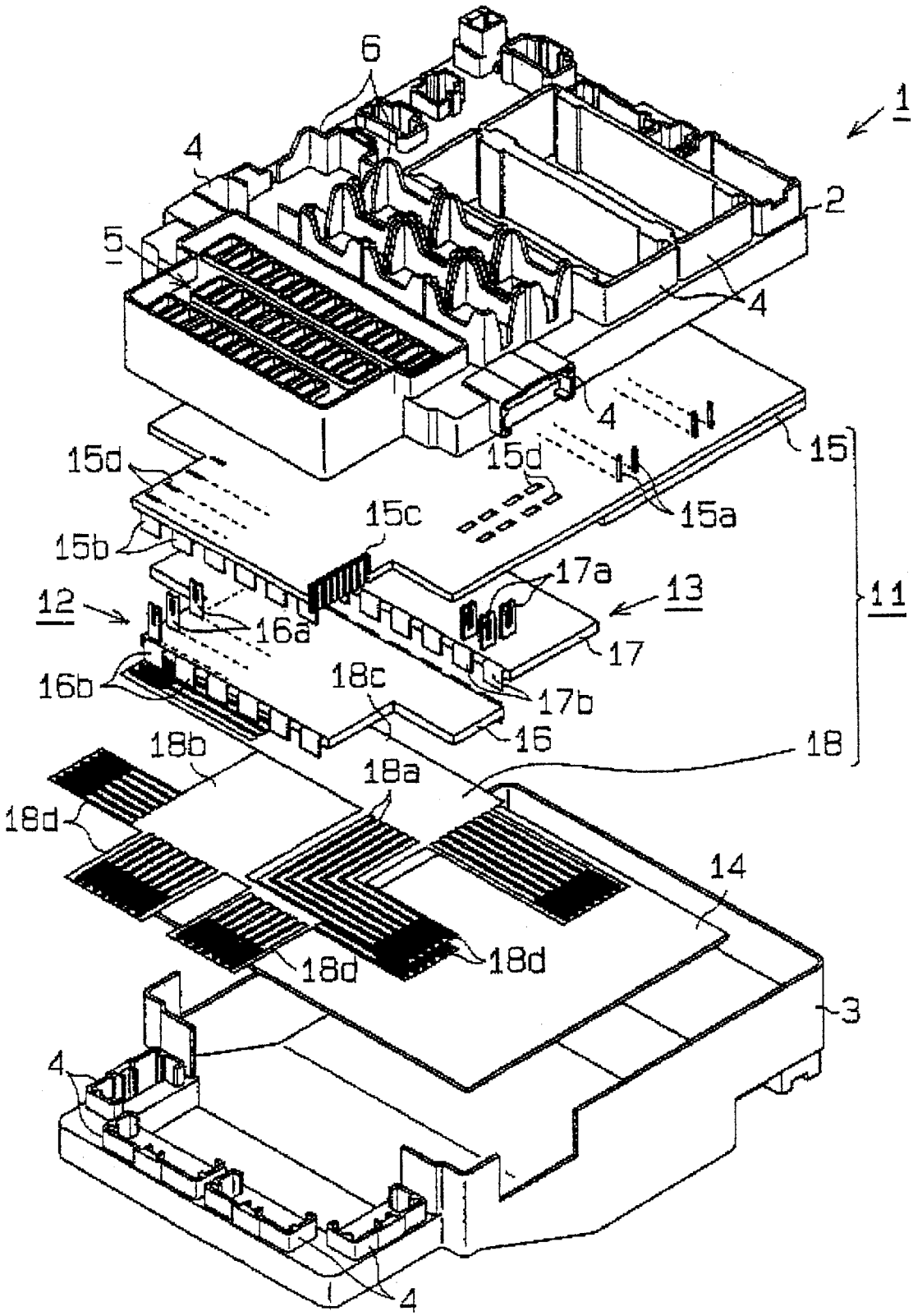
FIG. 1 is a perspective view of the components of an electrical connector housing according to a first embodiment of the invention.
Figure 2:
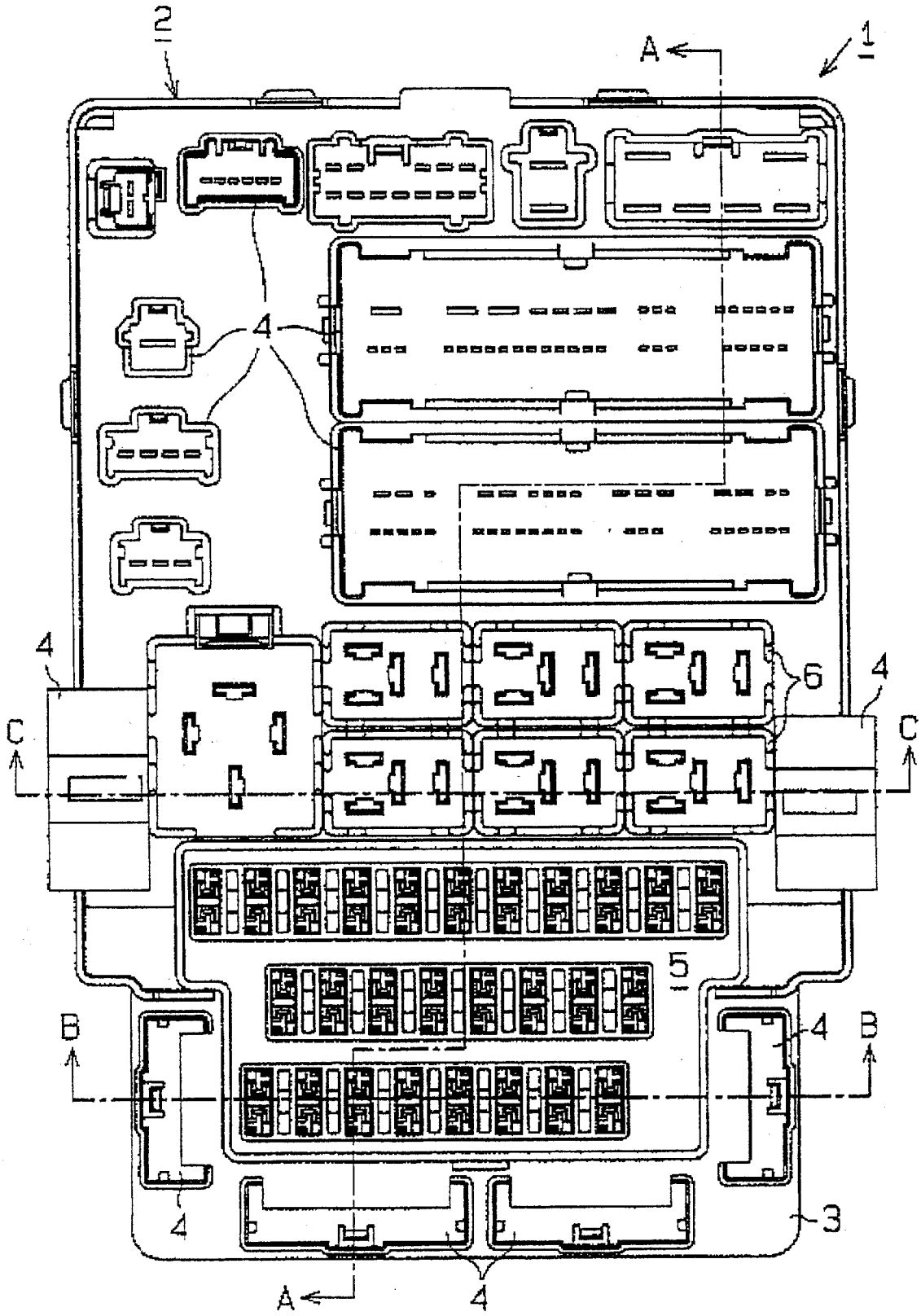
FIG. 2 is a top plan view of the electrical connector housing of FIG. 1.

As shown in FIGS. 1 and 2, an electrical connector housing 1 of the invention comprises a first shell 2 (top shell in the figures) and a second shell 3 (bottom shell in the figures). The external (top) surface of the first shell 2 is provided with first connector mounts 4, fuse mounts 5 and relay mounts 6, respectively making it possible to install several connectors, several fuses and several relays in a freely engageable and removable way. The external (bottom) surface of the second shell 3 is provided with second connector mounts. Both shell 2 and 3 can fit to each other, thereby defining an internal space.

The electrical connector housing 1 contains a connector circuitry module 11, a fuse circuitry module 12, a relay circuitry module 13 and a printed board 14. Each circuit module 11, 12 or 13 is formed of first, second and third bus bar stacks 15,16 and 17 and a flexible printed board 18. The first, second and third bus bar stacks 15, 16 and 17 are respectively formed by laminating in alternating fashion a plurality of bus bars (made of conductor metal plates of a given form) and layers of an insulator material made of a synthetic resin. The flexible printed board 18 is formed by coating a given shape of copper foil patterns 18*a* with resin sheets. This flexible printed board 18 includes a first base board 18*b* and a second base board 18*c* in two-layer structure, each containing copper foil patterns. The copper foil patterns 18*a* in the respective board bases 18*b* and 18*c* are electrically connected e.g., by ultrasonic welding. In the present embodiment, the copper foil patterns 18*a* in the flexible printed board 18 have a thickness of about 0.1 mm and a width of about 2 mm, so as to pass a current of 10 Amperes at the most.

Figure 3:
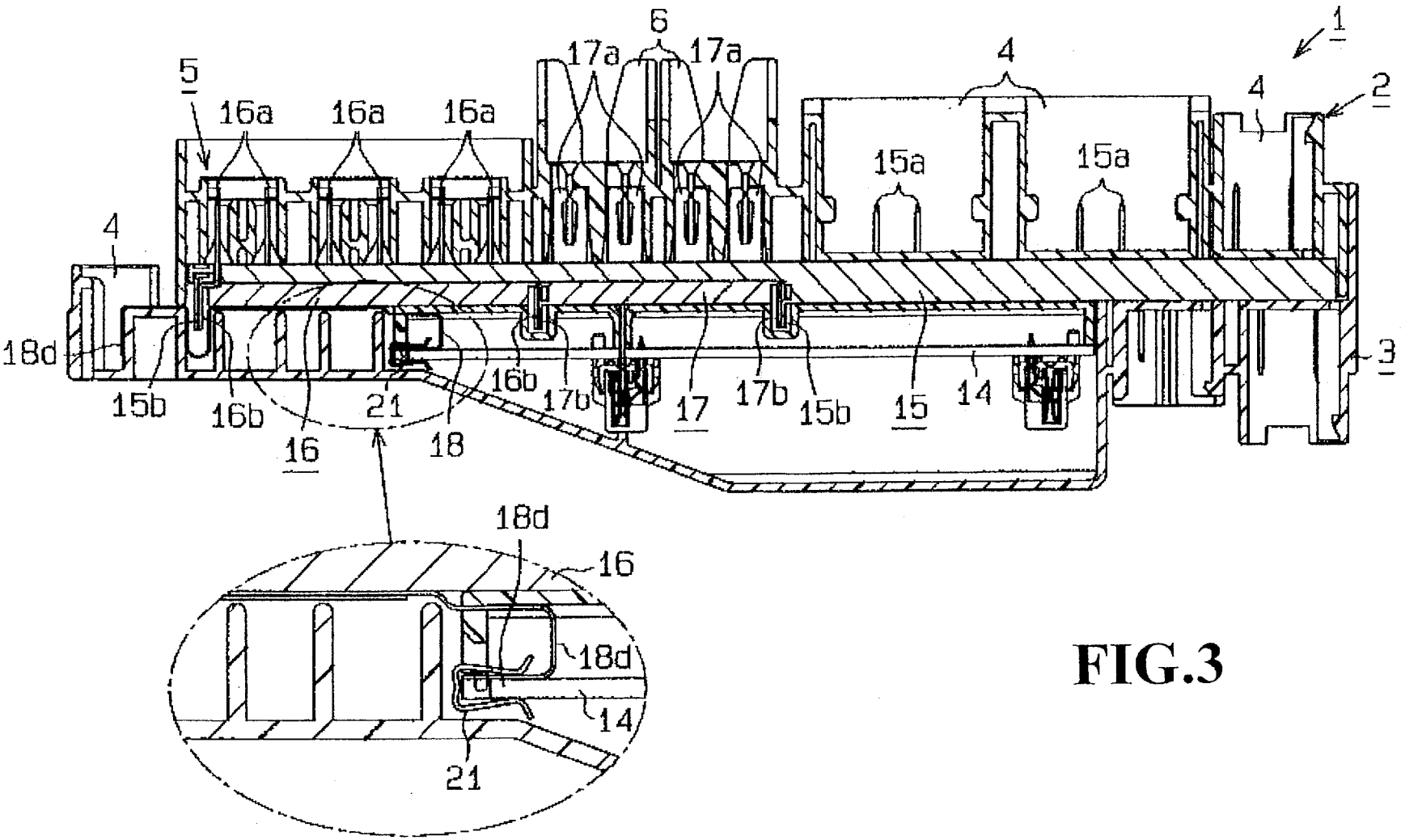
FIG. 3 is a cross-sectional view taken along line A—A of the electrical connector housing of FIG. 2.

The connector circuitry module 11 includes connector-connecting circuits, and is formed into the first bus bar stack 15 and a flexible printed board 18. In the above connector-connecting circuits, a current equal to, or less than, 10 Amperes is passed through the flexible printed board 18, while a current surpassing 10 Amperes is passed through the first bus bar stack 15. Namely, a low-level electric current is passed through the flexible printed board 18. In the present embodiments, the first shell 2 is located above the second shell 3. The first bus bar stack 15 is somewhat smaller than the first shell 2, and has partially a two-layer structure, the rest having four-layer structure. The top face (viewed in FIG. 1) of the first bus bar stack 15 is provided with a plurality of bus bar terminals 15*a* extending upwardly therefrom. The bus bar terminals 15*a* are formed by bending a part of each bus bar. They are formed at positions corresponding to a respective first connector mount 4 formed on the first shell 2. As shown in FIG. 3, a first side edge of the first bus bar stack 15 (viewed in FIG. 1) is provided with a plurality of first strips 15*b* extending downwardly therefrom. These first strips 15*b* are also formed by bending a part of the bus bars. A second side edge of the first bus bar stack 15 adjacent the first side edge is provided with board-bound connectors 15*c* (relayed from the flexible printed board), which are formed by bending a part of each bus bar upwardly. The first bus bar stack 15 further includes holes 15*d*, through which second and third bus bar terminals 16*a* and 17*a* described infra are passed. The flexible printed board 18 includes connector terminals 118*d* at positions corresponding to some of the first connector mounts 4.

The fuse circuitry module 12 includes fuse-connecting circuits and is formed into the second bus bar stack 16. The latter has a two layer structure. The top face (viewed in FIG. 1) of the second bus bar stack 16 is provided with a plurality of second bus bar terminals 16*a* extending upwardly therefrom. These terminals 16*a* are formed by bending a part of each bus bar, and are located at the positions corresponding to the fuse mounts 5. As shown in FIG. 3, each second bus bar terminal 16*a* has a shape engageable with a male-type terminal. Further, as shown in FIG. 3, two opposing side edges of the second bus bar stack 16 are respectively provided with a plurality of second strips 16*b* extending downwardly therefrom. These second strips 16*b* are provided at the edge of the second bus bar stack 16, and positioned so as to correspond to the first strips 15*b* provided at the edge of the first bus bar stack 15.

The relay circuitry module 13 includes relay-connecting circuits and is formed into the third bus bar stack 17. The third bus bar stack 17 has a two-layered structure. The top face thereof is provided with a plurality of third bus bar terminals 17*a* extending upwardly therefrom. These bus bar terminals 17*a* are formed by bending a part of each bus bar, and are placed at the positions corresponding to the relay mounts 6. As shown in FIG. 3, each of the third bus bar terminal 17*a* has a shape engageable with a male-type terminal. One side edge of the third bus bar stack 17 is provided with a plurality of third strips 17*b* extending downwardly therefrom. These strips 17*b* are placed so as to correspond to the positions of the first strips 15*b* of the first bus bar stack 15.

The circuitry modules 11, 12 and 13 thus produced are arranged in an electrical connector housing 1, in order from top to bottom, the first bus bar stack 15, an intermediate layer composed of second bus bar stack 16 and third bus bar stack 17, and a flexible printed board 18. FIG. 3 shows the above construction in more detail. More particularly, the second and third bus bar stacks 16 and 17 are arranged side-by-side in the space under the first bus bar stack 15 where the latter has two-layered structure. These first, second and third bus bar stacks 15, 16 and 17 are then flanked by the flexible printed board 18. The flexible printed board 18 is thus arranged along those faces of the first, second and third bus bar stacks 15, 16 and 17 where no bus bar terminal is provided. Further, the flexible printed board 18 is flanked by a printed board 14 from below.

When those bus bar stacks 15, 16 and 17 are contained in the electrical connector housing 1, the second and third bus bar terminals 16*a* and 17*a*, respectively of the second and third bus bar stacks 16 and 17, pass through the holes 15*d* of the first bus bar stack 15. Simultaneously, the first, second and third strips 15*b*, 16*b* and 17*b*, respectively of the first, second and third bus bar stacks 15, 16 and 17, are placed into contact with one another, as shown in FIG. 3. Those strips 15*b*, 16*b* and 17*b* are then connected e.g. by ultrasonic welding. The bus bar stacks 15, 16 and 17 are thus electrically connected to one another.

Figure 4:
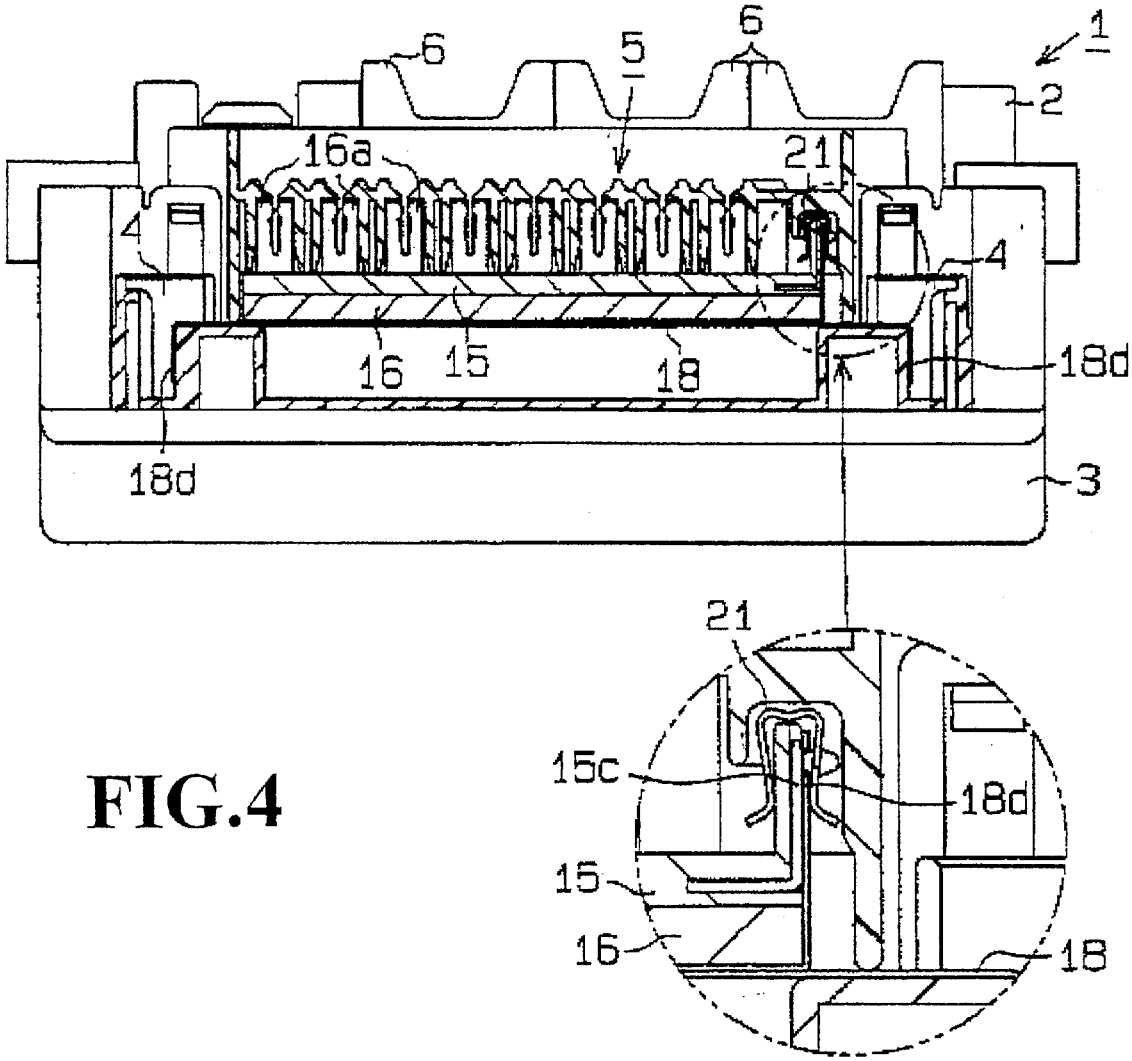
FIG. 4 is a cross-sectional view taken along line B—B of the electrical connector housing of FIG. 2.
Figure 5:
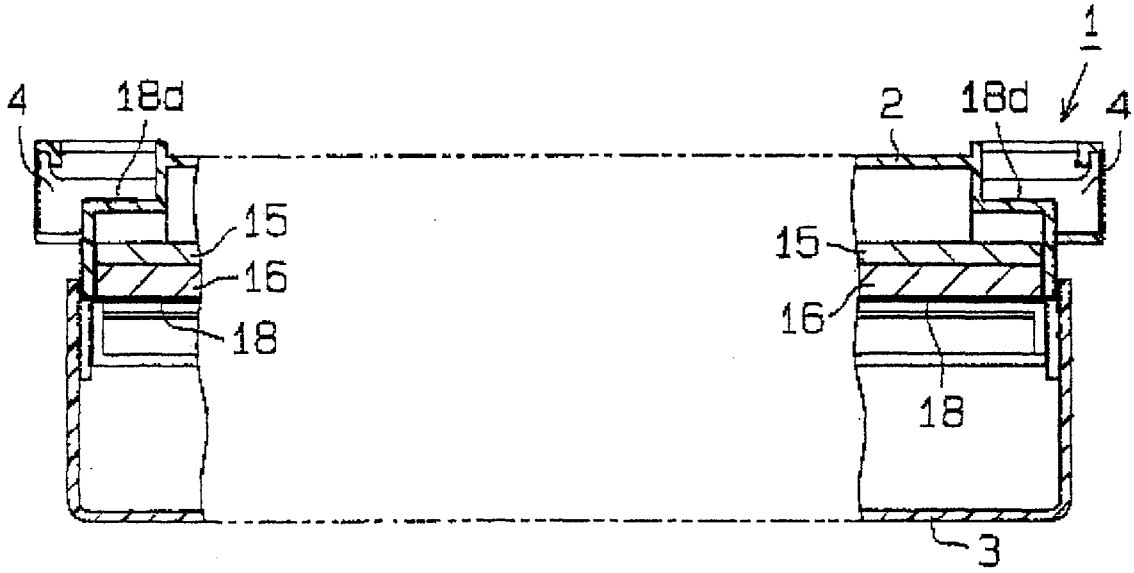
FIG. 5 is a cross-sectional view taken along line C—C of the electrical connector housing of FIG. 2.

As shown in FIG. 3, some of the connector terminals 18*d* of the flexible printed board 18 are bent so as to be placed into contact with conductor patterns (not shown in the figures) wired on the printed board 14. Those connector terminals 18*d* and the printed board 14 are then clamped by connector clips 21, so that the former 18*d* and the conductor patterns of the printed board 14 are electrically connected. As shown in FIG. 4, some of the connector terminals 18*d* of the flexible printed board 18 are bent such as to be placed into contact with the board-bound connectors 15*c* formed on the first bus bar stack 15. The connector terminals 18*d* and the board-bound connectors 15*c* are then clamped by connector clips 21, and electrically connected. The remaining connector terminals 18*d* are wired into corresponding connector mounts 4, as shown in FIGS. 3 to 5.

The above-mentioned embodiments give the following advantages.

Firstly, the connector-connecting circuits, the fuse-connecting circuits and the relay-connecting circuits are separately formed into a connector circuitry module 11, a fuse circuitry module 12 and a relay circuitry module 13, respectively. Accordingly, when one circuit is to be re-configured, for instance, it will suffice to modify only the circuitry module 11, 12 or 13 including such circuit.

Further, the zone involving a small electric current in the connector circuitry module 11 is made of a flexible printed board 18, so that the connector module can be made small and light. As a result, the electrical connector housing 1 is also made small and light. Furthermore, the flexible printed board 18 can be changed independently. The circuits in the connector circuit module 11 can thus be modified very easily.

Secondly, the flexible printed board 18 is disposed adjacent the face of bus bar stacks 15, 16 and 17 where no bus bar terminal 15*a*, 16*a* or 17*a* is formed. Accordingly, there is no need for providing a means by which the bus bar terminals 15*a*, 16*a* and 17*a* are passed through the flexible printed board 18. In addition, the copper foil patterns 18*a* of the flexible printed board 18 can be designed freely, taking no account of the arrangements of the bus bar terminals 15*a*, 16*a* and 17*a*. The configuration of the flexible printed board 18 can thus be simplified. Consequently, the flexible printed board 18 can be designed and produced in a simpler way, and thus kept small.

Thirdly, the bus bar stacks 15, 16 and 17 are electrically connected to one another by welding the corresponding strips 15*b*, 16*b* and 17*b*. In this manner, the above stacks can be connected to one another electrically very securely. Further, the copper foil patterns 18*a* of the flexible printed board 18 on the one hand, and the conductor patterns of the printed board 14 or the board-bound connector 15*c* of the first bus bar stack 15 on the other, are connected by clamping the connecting clips 21. They can thus be connected firmly and easily.

In the fourth place, the copper foil patterns 18*a* of the flexible printed board 18 are configured to have a thickness of about 0.1 mm and a width of about 2 mm, so that a current of 10 Amperes at the most can be passed. Generally, their thickness is set at 0.035 mm. Under the above conditions, the copper foil patterns 18*a* never require a width exceeding about 2 mm. Therefore, the size of the flexible printed board 18 can be scaled down.

Further, the above first to third embodiments of the invention may be modified as follows.

The connector circuitry module 11 of the above embodiments is formed into a first bus bar stack 15 and a flexible printed board 18. However, the connector circuitry module 11 may be formed only of a flexible printed board 18.

Likewise, the two-layer structure of the flexible printed board 18 may be replaced by a one-layer structure, or a three or further layer structure.

In the first to third embodiments, the copper foil patterns 18*a* are designed to pass a current of 10 Amperes at the most. However, passable currents may be raised to over 10 Amperes by modifying the thickness and width of the foil patterns 18*a*.

Further, when connecting the flexible printed board 18, the printed board 14 and the first bus bar stack 11, they may be welded, instead of being connected by clips 21.

In the first to third embodiments, the printed board 14 is contained in the electrical connector housing 1. Instead, it may be placed outside the housing 1.

In the first to third embodiments, the flexible printed board 18 is located under the first, second and third bus bar stacks 15, 16 and 17. Instead, it may be placed over the stacks 15, 16, and 17. In such a case, the flexible printed board 18 is preferably arranged in the zone where no bus bar terminal 15*a*, 16*a* or 17*a* is formed.

Further, in the first to third embodiments, part of only the connector circuitry module 11 is made of a flexible printed board 18. Alternatively or simultaneously, part of the fuse circuitry module 12 and/or the relay circuitry module 13 may be formed of a flexible printed board 18.

Further, in the connector circuitry module 11 of the first to third embodiments, all connector-connecting circuits for current paths of no more than 10 Amperes are formed of a flexible printed board 18. Instead, only part of such current paths may be formed of a flexible printed board 18. In particular, a bus bar stack may be formed for current paths involving currents of less than 10 Amperes. Then, even if mixed current paths of above and below 10 Amperes co-exist in a connector mount 4, the connecting terminals 18*d* of the flexible printed board 18 and the bus bar terminals 15*a* of the first bus bar stack 15 can be separated nonetheless.

Further in the first to third embodiments, the first shell 2 and the second shell 3 are allocated to the top shell and the bottom shell in FIG. 1, respectively. In a running vehicle however, their position may be reversed. Moreover, the first and second shells 2 and 3 may take any direction other than the above.

The copper foil patterns of the first base board 18*a* and of the second base board 18*b*, both base boards forming a flexible printed board 18, may be electrically connected by ultrasonic welding, but also by resistance welding or laser welding.

As can be understood from above, the invention creates the following advantages.

(1) In the electrical connector housing, the flexible printed board is designed so as to allow the passage of a current of about 10 Amperes.

(2) The above electrical connector housing also contains a printed board, and the latter and the flexible printed board may be clamped by connecting clips. In this manner, the conductor patterns of the flexible printed board and of the printed board are electrically connected.

(3) The first shell is equipped with connector mounts, fuse mounts and relay mounts. The second shell is mounted to the first shell so as to form a housing. The electrical connector housing thus produced contains, separately, a connector circuitry module, a fuse circuitry module and a relay circuitry module respectively comprising connector-connecting circuits, fuse-connecting circuits and relay-connecting circuits. At least part of the connector circuit module is then formed of a flexible printed board.

(4) The electrical connector housing contains bus bar stacks, each stack being formed by laminating at least one group of bus bars and layers of an insulator material. Connecting circuits are divided as a function of the type of electrical component mounts into which they are wired, and grouped into a separated circuitry module. Then, at least part of a given separated circuitry module is formed of a flexible printed board.

Although the invention has been described with reference to particular means, materials and embodiments, it is to understood that the invention is not limited to the particulars disclosed and extends to all equivalents within the scope of the claims.

The present disclosure relates to subject matter contained in priority Japanese Application No. 2000-238838, filed on Aug. 7, 2000, which is herein expressly incorporated by reference in its entity.

What is claimed:

1. An electrical connector housing comprising a first shell carrying connector mounts, fuse mounts and relay mounts, and a second shell fitted to the first shell, the electrical connector housing containing at least a first bus bar stack formed by a lamination of at least one group of bus bars and layers of insulator material, said electrical connector housing comprising:

a connector circuitry module being formed of said first bus bar stack and including connector-connecting circuits wired into said connector mounts;

a fuse circuitry module being formed of a second bus bar stack including a lamination of at least one group of bus bars and layers of insulator material and including fuse-connecting circuits wired into said fuse mounts;

a relay circuitry module being formed of a third bus bar stack including a lamination of at least one group of bus bars and layers of insulator material and including relay-connecting circuits wired into said relay mounts; and said connector circuitry module further comprising a flexible printed board containing conductor patterns;

wherein said first bus bar stack comprises bus bar terminals projecting therefrom and arranged into said fuse mounts and said relay mounts, said first bus bar stack comprising an area where no bus bar terminal is formed, and said flexible printed board is arranged in said area; and wherein said circuitry modules are arranged in said electrical connector housing in order from top to bottom, a top layer including said first bus bar stack, an intermediate layer including said second bus bar stack and said third bus bar stack next to each other, and a bottom layer including said flexible printed board, so that said first, second, and third bus bar stacks contact said flexible printed board.

2. The electrical connector housing according to claim 1, wherein said area comprises that face of said first bus bar stack where no bus bar terminal is provided.

3. The electrical connector housing according to claim 1, wherein said first bus bar stack comprises bus bar terminals projecting therefrom and arranged into said fuse mounts and said relay mounts, said first and second bus bar stacks comprising an area where no bus bar terminal is formed, and said flexible printed board is arranged in said area.

4. The electrical connector housing according to claim 1, wherein said first bus bar stack comprises bus bar terminals projecting therefrom and arranged into said fuse mounts and said relay mounts, said first, second and third bus bar stacks comprising an area where no bus bar terminal is formed, and said flexible printed board is arranged in said area.

5. The electrical connector housing according to claim 1, wherein said bus bars of said first, second and third bus bar stacks are electrically connected to one another by welding, and said flexible printed board and at least one of said first, second and third bus bar stacks awe clamped by clips, so that said conductor patterns of said flexible printed board and said bus bars of said first, second and third bus bar stacks are electrically connected.

6. The electrical connector housing according to claim 3, wherein said area comprises those faces of said first and second bus bar stacks where no bus bar terminal is provided.

7. The electrical connector housing according to claim 4, wherein said area comprises those faces of said first, second and third bus bar stacks where no bus bar terminal is provided.

8. The electrical connector housing according to claim 4, wherein said bus bars of said first, second and third bus bar stacks are electrically connected to one another by welding, and said flexible printed board and at least one of said first, second and third bus bar stacks are clamped by clips, so that said conductor patterns of said flexible printed board and said bus bars of said first, second and third bus bar stacks are electrically connected.

9. The electrical connector housing according to claim 7, wherein said bus bars of said first, second and third bus bar stacks are electrically connected to one another by welding, and said flexible printed board and at least one of said first, second and third bus bar stacks are clamped by clips, so that said conductor patterns of said flexible printed board and said bus bars of said first, second and third bus bar stacks are electrically connected.

* * * * *